United States Patent [19]

Martwick et al.

[11] Patent Number: 4,907,510

[45] Date of Patent: Mar. 13, 1990

[54] CASED TELESCOPED AMMUNITION HAVING FEATURES AUGMENTING CARTRIDGE CASE DIMENSIONAL RECOVERY BY CENTER SLEEVE

[75] Inventors: Wilford E. Martwick, Minneapolis; Brian B. Tasson, Anoka, both of Minn.

[73] Assignee: Honeywell Inc., Minneapolis, Minn.

[21] Appl. No.: 154,416

[22] Filed: Feb. 10, 1988

[51] Int. Cl.[4] ..... F42B 5/02

[52] U.S. Cl. ..... 102/434; 102/430; 102/464

[58] Field of Search ..... 102/430, 433, 434, 436, 102/440, 443, 464, 469

[56] References Cited

U.S. PATENT DOCUMENTS

| | | | |
|---|---|---|---|
| 300,449 | 6/1884 | Dickey . | |
| 331,511 | 12/1885 | Lorenz . | |
| 546,936 | 9/1895 | Pinfold . | |
| 702,208 | 6/1902 | Hayner . | |
| 1,062,604 | 5/1913 | Pedersen . | |
| 1,079,083 | 11/1913 | Wesson . | |
| 1,094,565 | 4/1914 | Hoagland . | |
| 1,974,270 | 9/1934 | Guignet | 102/12 |
| 2,349,970 | 5/1944 | Lambeek | 102/43 |
| 2,402,068 | 6/1946 | Meador | 148/12 |
| 2,535,624 | 12/1950 | Burney | 102/38 |
| 2,568,080 | 9/1951 | McGahey, Jr. | 102/38 |
| 2,853,945 | 9/1958 | Stealey | 102/44 |
| 2,866,412 | 12/1958 | Meyer et al. | 102/38 |
| 2,920,565 | 1/1960 | Heidmann | 102/43 |
| 2,938,458 | 5/1960 | O'Brien | 102/38 |
| 2,996,988 | 8/1961 | Kunz | 102/38 |
| 3,279,373 | 10/1966 | Stadler et al. | 102/44 |
| 3,568,599 | 3/1971 | Dardick | 102/38 |
| 3,590,740 | 7/1971 | Herter | 102/44 |
| 3,761,322 | 9/1973 | Winter et al. | 148/11.5 A |
| 3,892,181 | 7/1975 | Goldin | 102/443 |
| 3,948,178 | 4/1976 | Luther et al. | 102/43 R |
| 4,000,697 | 1/1977 | Levine | 102/38 |
| 4,197,801 | 4/1980 | LaFever et al. | 102/38 CC |
| 4,202,270 | 5/1980 | Luther et al. | 102/43 R |
| 4,220,089 | 9/1980 | Smith | 102/38 R |
| 4,335,657 | 6/1982 | Bains | 102/433 |
| 4,604,954 | 8/1986 | Clarke et al. | 102/434 |

FOREIGN PATENT DOCUMENTS 400801 11/1933 United Kingdom .

*Primary Examiner*—Harold I. Tudor
*Attorney, Agent, or Firm*—Roger W. Jensen

[57] ABSTRACT

A cased telescoped ammunition round includes a propellant charge disposed in a tubular case and having an axial bore containing a center sleeve attached at its opposite ends to the opposite ends of the case. A projectile is housed within a forward portion of the center sleeve and a primer within an aft portion thereof. The primer is actuatable for igniting the propellant charge to cause firing of the projectile. Features are provided to ensure dimensional recovery of the tubular case after firing of the projectile. One feature relates to the center tube being composed of a material which provides sufficient elasticity to stretch and contract uniformly from and to dimensions allowing ejection of the tubular case from the gun chamber. Another feature relates to longitudinal structural members provided to extend between and fasten to opposite ends of the case, and spaced circumferentially about and between the center sleeve and the case. Still another feature relates to a spring element formed integral with the center sleeve. A further feature relates to other spring elements provided as a separate component for coupling forward and aft portions of the center sleeve together.

5 Claims, 2 Drawing Sheets

CASED TELESCOPED AMMUNITION HAVING FEATURES AUGMENTING CARTRIDGE CASE DIMENSIONAL RECOVERY BY CENTER SLEEVE

CROSS REFERENCE TO RELATED APPLICATIONS

Reference is hereby made to the following copending U.S. patent application dealing with related subject matter and assigned to the same assignee of the present invention: "Cased Telescoped Ammunition Having Features Augmenting Cartridge Case Dimensional Recovery By Case Skin Tube" by W. Martwick, assigned U.S. Ser. No. 154,560 and filed Feb. 10, 1988.

BACKGROUND OF THE INVENTION

1. Field of the Invention

The present invention generally relates to cased telescoped ammunition and, more particularly, is concerned with features augmenting cartridge case dimensional recovery brought about by a center sleeve of the ammunition round.

2. Description of the Prior Art

Cased telescoped ammunition is generally well-known. Representative prior art versions of such ammunition are disclosed in U.S. Pat. Nos. to Meyer et al (2,866,412), Kunz (2,996,988), LaFever et al (4,197,801), Smith (4,220,089), Bains (4,335,657) and Clarke et al (4,604,954).

Typically, a round of cased telescoped ammunition includes an elongated cylindrical case defining a chamber that contains a propellant charge. The propellant charge has an axial bore through which extends a center sleeve in coaxial relation with the case and fastened at its opposite ends to the opposite ends of the case. A telescoped projectile is housed within a forward portion of the center sleeve, whereas an aft portion of the center sleeve, referred to as a control tube, receives a piston or spud on the aft end of the projectile. A primer is positioned within the control tube aft of the projectile spud, and a small amount of propellant is contained therein between the primer and the spud.

The round of ammunition is loaded in a gun chamber located rearwardly of the gun barrel. When the round is fired, the primer ignites the small amount of propellant in the control tube. The resulting gas applies a force against the spud, driving the projectile forwardly out of the center sleeve and into the gun barrel. Next, the hot gas ignites the main propellant charge surrounding the projectile. Burning of the propellant charge produces gas at much higher pressure which drives the projectile through the gun barrel to exit the muzzle at high velocity.

The increasing pressure created by the burning propellant charge expands the ammunition case axially and radially. Expansion of the case is constrained by the opposite ends and cylindrical interior surface of the gun chamber housing the ammunition round. The pressure also acts to elastically deform the gun, enlarging the chamber. Then, when the pressure is relieved by exit of the projectile from the gun barrel, the gun chamber reverts to its unpressurized dimensions. In order to extract the case from the gun chamber, it is necessary that the case return or recover at least to dimensions which allow clearance between it and the ends and interior surface of the chamber.

Because elastic deformations of typical guns using cased telescoped ammunition are so large, special steps are required to attain the cartridge case springback required. In a typical round currently available, one step taken is to split longitudinally the skin tube of the cartridge case to relieve any pressure between the yielded skin tube and the recovered chamber diameter The end caps are free to move relative to the split skin tube and require special measures to maintain some connection between the end caps and split skin tube. The special measures required to connect the end caps and tube skin make for unreliable cartridge case integrity, particularly after firing. Also, splitting of the skin tube allows undesirable contamination of the gun chamber to occur during firing of the round.

Therefore, a need still exists for a different approach to achievement of dimensional recovery of a cased telescoped ammunition round.

SUMMARY OF THE INVENTION

The present invention provides cased telescoped ammunition designed to satisfy the aforementioned needs. The present invention encompasses several different features associated with the center sleeve of a round of cased telescope ammunition for augmenting cartridge case dimensional recovery by the center sleeve. Some of these features are advantageously incorporated together to realize significantly improved cartridge case dimensional recovery; however, improvement of dimensional recovery can be obtained by employment of certain of the features separately from or as alternatives to certain of the others.

The cased telescoped ammunition round in which the features of the present invention are employed comprises the combination of: (a) an elongated propellant charge having an axial bore therethrough; (b) an elongated tubular case having opposite ends and defining a chamber that contains the propellant charge; (c) a center sleeve disposed in the case through the axial bore of the propellant charge and attached at its opposite ends to the opposite ends of the case; (d) a projectile housed within a forward portion of the center sleeve; and (e) a primer positioned within an aft portion of the center sleeve and being actuatable for igniting the propellant charge for causing firing of the projectile forwardly from the center sleeve and the case.

One feature relates to the provision of an elastic center sleeve in the round designed to resiliently stretch in response to high internal pressures created by burning of the propellant charge for firing of the projectile and then to return or contract to its original dimensions in response to relief of the pressure. More particularly, by selection of the proper material for the center sleeve, it can be designed such that upon firing of the round the longitudinal stress encountered by the sleeve will uniformly exceed the yield stress of its material. As a result of the material selected and the particular sleeve design, the sleeve will shorten on relief of the internal pressure by an amount equal to the ratio of the yield stress or strength to the modulus of elasticity for the particular material times the free length of the sleeve.

Another feature is directed to the use of a plurality of longitudinal structural members. The structural members are provided so as to extend between and fasten to opposite ends of the case Also, the structural members are spaced circumferentially about and between the center sleeve and the case of the round.

Still another feature concerns the use of spring means formed integral with the center sleeve for augmenting its recovery. For example, a portion of the center sleeve at the merger of its forward and aft portions is arcuately configured in a direction which resiliently resists elongation of the center sleeve.

Yet another feature relates to the use of spring means which is provided as a component separate from the center sleeve for augmenting its recovery. For example, the center sleeve can be separated into forward and aft portions which are coupled together by the spring component.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Cased Telescoped Ammunition

Figure 1:
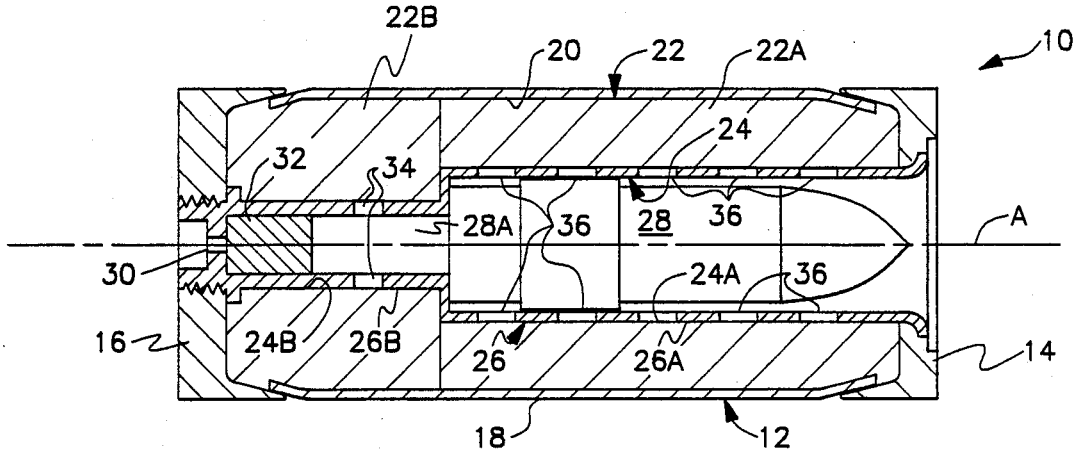
Fig. 1 (PRIOR ART)
FIG. 1 is a longitudinal axial sectional view of a prior art cased telescoped ammunition round.
Figure 2:
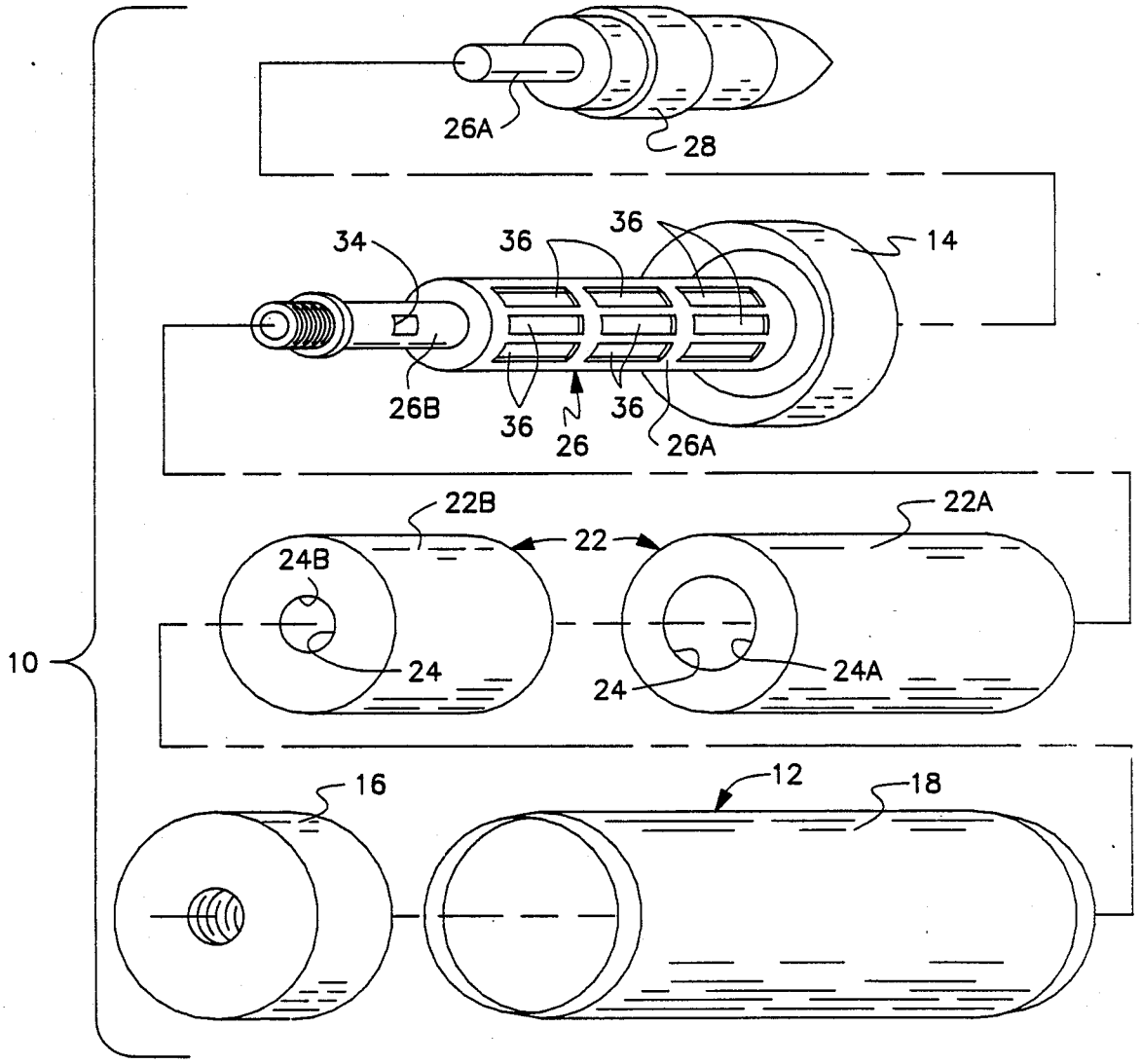
Fig. 2 (PRIOR ART)
FIG. 2 is an exploded perspective view of the prior art round of FIG. 1.

Referring now to FIGS. 1 and 2 of the drawings, there is shown a prior art round of cased telescoped ammunition, generally designated by the numeral 10. The ammunition round 10 includes an elongated cylindrical case 12 composed of a pair of forward and aft end seals or caps 14, 16 sealed on opposite ends of a skin tube 18. The case 12 defines a chamber 20 that contains a propellant charge 22 composed of forward and aft portions 22A, 22B. The propellant charge 22 has an axial bore 24 (composed of corresponding forward and aft portions 24A, 24B) through which extends a center sleeve in coaxial relation with the case 12. The center sleeve 26 is fastened at its opposite ends to the end caps 14, 16.

A projectile 28 is housed within a forward end portion 26A of the center sleeve 26. An aft end portion of the center sleeve 26, referred to as a control tube 26B, has a substantially smaller diameter size and is shorter in length than the forward end portion 26A thereof. The projectile 28 incorporates a short piston or spud 28A of reduced diameter on its aft end which extends in a close fitting relation into the control tube 26B of the center sleeve 26. A primer 30 is also positioned within the control tube 26B aft of the projectile spud 28A and a small amount of propellant 32 is contained in the control sleeve 26B between the primer 30 and the projectile spud 28A. Windows or vents 34, 36 are respectively formed through the aft end portion or control tube 26B and the forward end portion 26A of the center sleeve 26.

In operation, the primer 30 is fired initiating the small amount of propellant 32 in the control tube 26B aft of the projectile spud 28A. Expansion of the resulting gas generated by the initiated propellant 32 applies an increasing force against the spud 28A, driving the projectile 28 forward out of the center sleeve 28 and into the rear end of a gun barrel. As the end of the projectile spud 28A moves forward in the control tube 26B of the center sleeve 26, it exposes the vents 34 therein and thereafter the vents 36 in the forward end portion of the center sleeve 26. The hot gas generated by the initiated propellant 32 then ignites the main propellant charge 22 surrounding the projectile 28. Burning of the propellant charge 22 produces gas at much higher pressure which drives the projectile through the gun barrel to exit the muzzle at high velocity.

The increasing pressure created by the burning propellant charge 22 elongates the case skin tube 18 and forces the end caps 14, 16 apart to the point where they are constrained by the opposite ends of a gun chamber (not shown) which houses the ammunition round 10. The pressure also forces the case skin tube 18 radially outward into intimate contact with the cylindrical interior surface of the gun chamber. After intimate contact has been achieved, the pressure continues to increase and act to elastically deform the gun, enlarging the chamber and forcing apart the ends thereof.

When the pressure is relieved by the exit of the projectile from the muzzle of the barrel, the gun chamber reverts to its unpressurized dimensions. In order to extract the case 12 from the cylindrical gun chamber, it is necessary that the case 12 return or recover at least to dimensions which allow clearance between the end caps 14, 16 of the case 12 and the opposite breech and barrel faces or ends of the chamber as well as radially between the case 12 and interior cylindrical surface of the chamber. It is essential that features be incorporated in the ammunition which will ensure that such dimensional recovery takes place. These features of the present invention will now be described in detail.

Resiliently-Stretchable Center Tube

One feature of the present invention relates to the design of sufficient elasticity into the center sleeve 26 to make dimensional recovery possible. Particularly, the center sleeve 26 of the round 10 is designed to resiliently stretch in response to high internal pressures created by burning of the propellant charge 22 for firing of the projectile 28 and then to return or contract to its original dimensions in response to relief of the pressure. By selection of the proper material for the center sleeve 26, it can be designed such that upon firing of the round 10 the longitudinal stress encountered by the sleeve 26 will uniformly exceed the yield stress of its material. As a result of the material selected and the particular sleeve design, the sleeve 26 will shorten on relief of the internal pressure by an amount equal to the ratio of the yield stress or strength to the modulus of elasticity for the particular material times the free length of the sleeve 26.

By way of example, the material used to fabricate the sleeve 26 can be stainless steel. To compensate for the presence of the vents 34, 36 therein when designing the sleeve 26 to provide uniform stretching and shorting of its material throughout its length, the material of the sleeve 26 will need to be thicker in the regions thereof adjacent the vents than other uninterrupted regions thereof so that the total quantity of material will the same in any axial cross section of the sleeve 26.

It is this recovery or shortening of the yielded sleeve to a zero stress condition that will pull the end caps 14, 16 of the case 12 together to a length that will allow free ejection from the gun chamber. The center sleeve 26 so designed provides a solid means to connect and maintain the position of the end caps 14, 16 which allows the case skin tube 18 to be split, if desired, without destroying the integrity of the cartridge case 12.

However, as a practical matter, the design of some guns may be such that elastic deformation of the gun chamber (lengthwise from its breech face to barrel face) may exceed the dimensional recovery achievable by the center sleeve alone. In those instances, various other features of the present invention, either alone or with the elastic center sleeve, can be used to respectively augment the recovery provided by the elastic sleeve or to accomplish such recovery by themselves. In such manner, ejection of the fired cartridge case from the gun chamber is facilitated. These other features will now be described. The same reference numerals will be used to designate parts generally similar to those above.

Longitudinal Structural Members Spaced About Center Tube

Figure 3:
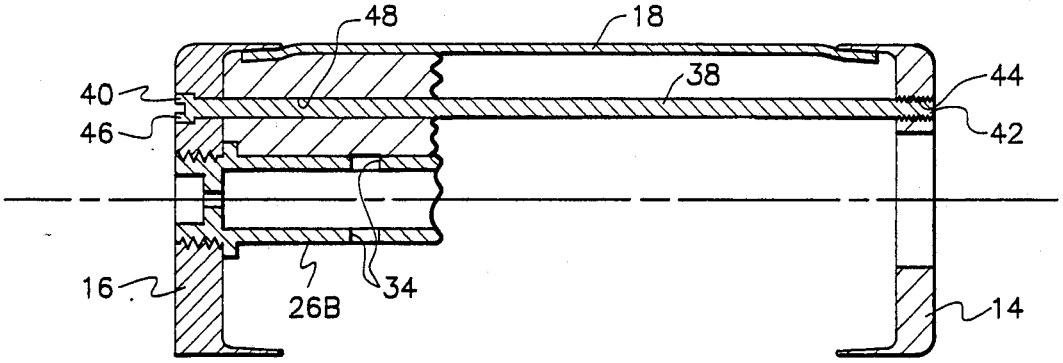
FIG. 3 is a longitudinal axial sectional view of a fragmentary portion of a cased telescoped ammunition round similar to that of FIG. 1 but incorporating one feature of the present invention for augmenting dimensional recovery of the ammunition case.

Turning now to FIG. 3, there is shown another feature of the present invention whose purpose is to augment dimensional recovery of the cartridge case 12 brought about by the center sleeve 26 or the achievement of such recovery by the provision of this feature alone. The feature is directed to the use of a plurality of elongated longitudinal structural members 38 (only one of which is illustrated in FIG. 3).

More particularly, the structural members 38, preferably in the form of long metal screws, extend between and fasten to forward and aft end caps 14, 16 of the case 12. As seen in FIG. 3, the structural member 38 has a grooved head 40 at one end and threads 42 at an opposite end. To accommodate each structural member 38, a threaded hole 44 is tapped through the forward end cap 14 to receive the threads 42 of the member 38, whereas the head 40 of the member seats in a countersunk hole 46 in the aft end cap 16. Also, the structural members 38 are circumferentially spaced about and between the center sleeve 26 and the case 12. To accommodate the structural members 38 about the center sleeve 26 and the control tube 26A thereof, a plurality of elongated bores 48 (only one bore 48 being shown in FIG. 3) are correspondingly formed longitudinally through the propellant charge 22 to receive the plurality of members 38.

It should be realized that when the structural members 38 are used alone to provide for recovery of the case 12, the forward end portion 26A of the center sleeve 26 need not be provided in the round 10. Only the control tube 26B of the center sleeve 26 needs to be employed in the round. The control tube 26B will function to hold the primer 30, the spud 28A of the projectile 28 and the quantity of propellant 32, to provide for delay in ignition of the propellant charge 22, and to assist in guiding the fired projectile into the gun barrel.

Spring Means Integral With Center Tube

Figure 4:
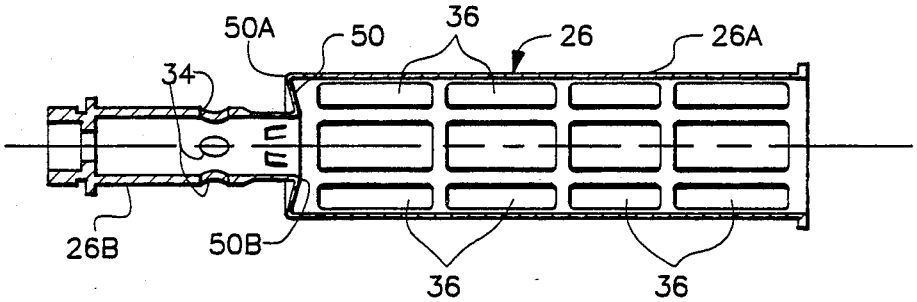
FIG. 4 is a longitudinal axial sectional view of a fragmentary portion of a cased telescoped ammunition round similar to that of FIG. 1 but incorporating another feature of the present invention for augmenting dimensional recovery of the ammunition case.

Turning now to FIG. 4, there is shown still another feature of the present invention whose purpose is the same as that of the structural members 38 -- to augment dimensional recovery of the cartridge case 12 brought about by the center sleeve 26 or the achievement of such recovery by the provision of this feature alone. The feature concerns spring means formed integral with the center sleeve 26 for augmenting its recovery.

Preferably, an integral intermediate portion of the center sleeve 26 located at the merger of its forward and aft portions 26A, 26B is an arcuately configured as an annular disk-like spring element 50. The spring element 50 is disposed in transverse relation to the longitudinal axis A of the case 12 and the center tube 26. The axial cross-section of the spring element 50 illustrated in FIG. 4, it can be seen that the spring element 50 has an inclined cross-sectional configuration extending from its outer peripheral edge 50A to its inner peripheral edge 50B in a direction pointing axially away from the aft portion of the sleeve. More particularly, the spring element 50 is concave-shaped in a direction extending axially toward the forward end cap 14 of the case 12 so that it will resiliently resist elongation of the center sleeve 26.

The spring element 50 thus acts as a belleville spring being resiliently yieldable to permit necessary elongation of the sleeve 26. However, the resilient nature of the spring element 50 ensures sufficient retraction the end caps 14, 16 of the case 12 toward one another after firing of the projectile 22 to achieve ejection of the cartridge case 12 from the gun chamber.

Spring Means Separate From Center Tube

Figure 5:
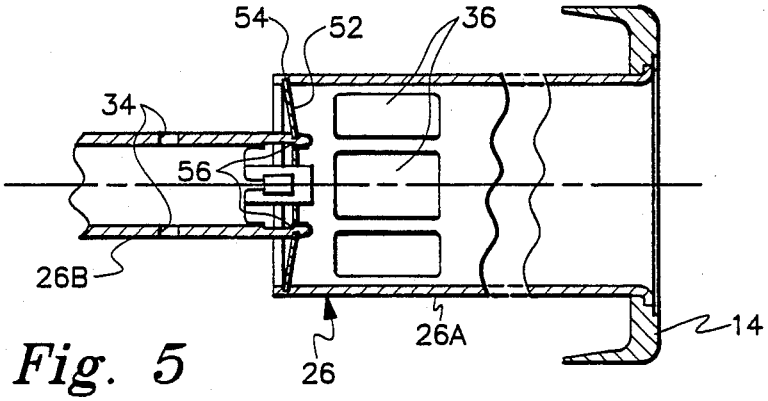
FIG. 5 is a longitudinal axial sectional view of a fragmentary portion of a cased telescoped ammunition round similar to that of FIG. 1 but incorporating still another feature of the present invention for augmenting dimensional recovery of the ammunition case.
Figure 6:
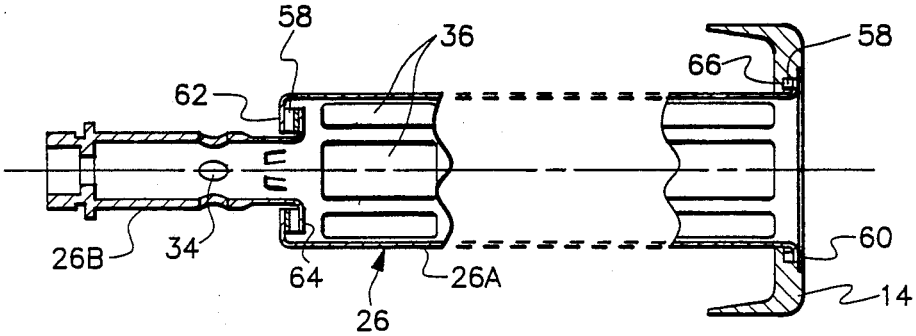
FIG. 6 is a longitudinal axial sectional view of a fragmentary portion of a cased telescoped ammunition round similar to that of FIG. 1 but incorporating yet another feature of the present invention for augmenting dimensional recovery of the ammunition case.

Turning now to FIGS. 5 and 6, there is shown yet another feature of the present invention whose purpose is the same as that mentioned above. The feature is directed to spring means which is provided as a component separate from but connected to the center sleeve 26 for augmenting its recovery. The center sleeve 26 is separated into its forward and aft portions 26A, 26B. The forward and aft sleeve portions 26A, 26B are then coupled together by the separate spring component.

In FIG. 5, the spring component is in the form of a annular disk-like spring element 52 generally similar in configuration and location to the integral spring element 50 in FIG. 4. The difference here is that the forward and aft portions 26A, 26B of the center tube 26 have respective internal peripheral groove 54 and notches 56 formed therein for gripping the spring element 52 at respective inner and outer peripheries thereof located at adjacent ends thereof.

In FIG. 6, the spring component is in the form of a pair of annular washer-like spring elements 58. Each spring element 58 has a circumferential configuration which is wavy or undulating in the direction of the axis A of the sleeve 26. The spring elements 58 are disposed respectively at the adjacent ends of the forward and aft portions 26A, 26B of the center sleeve 26 and at the connection between the forward end cap 14 and an outwardly-turned flange 60 on the forward end of the center sleeve 26.

In particular, the adjacent ends of the forward and aft center sleeve portions 26A, 26B have respective inwardly-turned and outwardly-turned flanges 62, 64 which extend in transverse relation to the axis A. One of the spring elements 58 is captured between the flanges 64, 62 maintaining them in axially spaced relation with respect to one another. An annular recess 66 is defined in the external side of the forward end cap 14. The other spring element 58 is seated therein, captured between the forward end cap 14 and the outwardly-turned flange 60 on the forward end of the center sleeve 26. Thus, the flange 60 is spaced forwardly of the bottom of the recess 66 by the other spring element 58. The spring elements 58 are composed of metal and are resiliently yieldable for permitting axial elongation of the center sleeve 26 while ensuring recovery thereof.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In a cased telescoped ammunition round, the combination comprising:

(a) an elongated propellant charge having an axial bore therethrough;

(b) an elongated tubular case having opposite ends and defining a chamber that contains said propellant charge;

(c) a center sleeve disposed in said case through said axial bore of said propellant charge and attached at its opposite ends to said opposite ends of said case;

(d) a projectile housed within a forward portion of said center sleeve;

(e) a primer positioned within an aft portion of said center sleeve and being actuatable for igniting said propellant charge for causing first of said projectile forwardly from said center sleeve and said case; and (f) resiliently-yieldable annular-shaped spring means extending between said forward and aft portions of said center sleeve and interconnecting said center sleeve portions at respective outer and inner peripheries of said spring means, said spring means having an inclined cross-sectional configuration extending from its outer peripheral edge to its inner peripheral edge in a direction pointing axially away from said aft portion of said center sleeve for resisting stretching and augmenting contraction thereof.

2. The ammunition round of claim 1 wherein said spring means is an integral portion of said center sleeve located at the merger of its forward and aft portions.

3. The ammunition round of claim 1 wherein said annular-shaped spring means is a disk-like element being concave-shaped in the direction extending axially away from said aft portion of said sleeve.

4. In a cased telescoped ammunition round, the combination comprising:

(a) an elongated propellant charge having an axial bore therethrough;

(b) an elongated tubular case having opposite ends and defining a chamber that contains said propellant charge;

(c) a center sleeve disposed in said case through said axial bore of said propellant charge and attached at its opposite ends to said opposite ends of said case;

(d) a projectile housed within a forward portion of said center sleeve;

(e) a primer positioned within an aft portion of said center sleeve and being actuatable for igniting said propellant charge for causing firing of said projectile forwardly from said center sleeve and said case; and (f) resiliently-yieldable spring means associated with said center sleeve and in the form of an annular disk-like element being concave-shaped in a direction extending axially away from said after portion of said sleeve for resisting stretching and augmenting contraction thereof.

5. The ammunition round of claim 4 wherein said spring means is an integral portion of said center sleeve located at the merger of its forward and after portions.

* * * * *